US010260845B2

(12) United States Patent
Hamilton et al.

(10) Patent No.: US 10,260,845 B2
(45) Date of Patent: Apr. 16, 2019

(54) MARKSMANSHIP TRAINING AID

(75) Inventors: Zachary Hamilton, San Antonio, TX (US); Susana A. Martinez, New Braunfels, TX (US); Ahmed Alshehri, Tanomah (SA); William Tirado, San Antonio, TX (US)

(73) Assignee: Board of Regents of the University of Texas System, Austin, TX (US)

( * ) Notice: Subject to any disclaimer, the term of this patent is extended or adjusted under 35 U.S.C. 154(b) by 0 days.

(21) Appl. No.: 13/567,686

(22) Filed: Aug. 6, 2012

(65) Prior Publication Data

US 2014/0038136 A1 Feb. 6, 2014
US 2017/0191806 A9 Jul. 6, 2017

Related U.S. Application Data

(60) Provisional application No. 61/515,504, filed on Aug. 5, 2011.

(51) Int. Cl.

*F41J 5/00* (2006.01)
*F41J 5/044* (2006.01)
*F41G 3/26* (2006.01)
*F41G 3/30* (2006.01)

(52) U.S. Cl.

CPC ..... *F41J 5/044* (2013.01); *F41G 3/26* (2013.01); *F41G 3/30* (2013.01)

(58) Field of Classification Search

CPC ..... F41G 1/00; F41G 3/00; F41G 3/26; F41G 3/2611; F41G 3/2644; F41G 3/30; F41J 5/044

USPC ..... 42/111–148; 434/11–27

See application file for complete search history.

(56) References Cited

U.S. PATENT DOCUMENTS

| | | | |
|---|---|---|---|
| 3,633,285 | A | 1/1972 | Sensney |
| 4,307,292 | A | 12/1981 | Knight et al. |
| 4,457,715 | A | 7/1984 | Compton et al. |
| 4,804,325 | A | 2/1989 | Willits et al. |
| 4,923,402 | A | 5/1990 | Marshall et al. |
| 5,281,142 | A | 9/1994 | Zaenglein et al. |
| 6,942,486 | B2 | 9/2005 | Lvovskiy |
| 7,329,127 | B2 | 2/2008 | Kendir et al. |

(Continued)

FOREIGN PATENT DOCUMENTS

| | | |
|---|---|---|
| CN | 2757090 | 2/2006 |
| GB | 191502112 | 2/1916 |
| RU | 2210051 | 8/2003 |

OTHER PUBLICATIONS

MPRI Sniper Training System V2, 2 Pages Sep. 4, 2009.

(Continued)

*Primary Examiner* — Timothy A Musselman
(74) *Attorney, Agent, or Firm* — Jackson Walker L.L.P.

(57) ABSTRACT

Various systems, devices, processes, and techniques may be used for marksmanship training. In particular implementations, motion data for a firearm may be acquired during live operation by a firearm operator using a sensor assembly coupled to a firearm. The motion data may be analyzed to detect a firing event, and the firing event may be used to pretrigger recording of the motion data. In certain implementations, the recorded motion data may be analyzed to determine inappropriate firing control actions, if any, and to provide corrective actions to a firearm operator about inappropriate firing control actions.

25 Claims, 7 Drawing Sheets

(56) References Cited

U.S. PATENT DOCUMENTS

| | | | | |
|---|---|---|---|---|
| 7,581,954 | B2 | 9/2009 | Schavone | |
| 7,677,893 | B2 | 3/2010 | Lvovskiy | |
| 7,832,137 | B2 | 11/2010 | Sammut et al. | |
| 2006/0201047 | A1* | 9/2006 | Lowrey, III | 42/122 |
| 2006/0204935 | A1 | 9/2006 | McAfee et al. | |
| 2008/0039962 | A1* | 2/2008 | McRae | 700/90 |
| 2009/0253103 | A1* | 10/2009 | Hogan, Jr. | F41A 9/61 434/24 |
| 2012/0015332 | A1* | 1/2012 | Stutz | 434/19 |
| 2013/0169820 | A1* | 7/2013 | Stewart | H04N 5/225 348/169 |
| 2013/0203019 | A1* | 8/2013 | Nolen | F41G 3/26 434/16 |

OTHER PUBLICATIONS

U.S. Marine Corps Weapons Training Battalion Lesson Plan, Analyzing the Fundamentals of Rifle Marksmanship, CMC-09, Combat Marksmaship Coaches Course, 18 Pages Aug. 12, 2008.

* cited by examiner

MARKSMANSHIP TRAINING AID

RELATED APPLICATIONS

This application claims priority to and the benefit of U.S. Patent Application Ser. No. 61/505,514, which was filed on Aug. 5, 2011, and is herein incorporated by reference.

BACKGROUND

Field of the Disclosure

This disclosure relates to the field of marksmanship training, and more particularly to systems and techniques for aiding marksmanship training.

Description of the Related Art

Basic marksmanship represents a skill set for safely and accurately operating a firearm and is obtained through training and experience. A firearm operator who has attained basic marksmanship skills will understand how to reduce operator error and ensure minimal barrel movement during weapon firing, which remains a widespread source of poor accuracy and precision, particularly when using a long weapon with a rifled barrel (e.g., a rifle) at greater distances. For example, at a range of 300 meters, a rifle barrel deflection of less than 1 degree is sufficient to miss most targets. Therefore, a relatively high degree of firing control is an important skill that basic marksmanship training can provide.

While various aspects of firing control may be practiced and perfected, four fundamental skills involving firing control actions by the firearm operator include steady positioning, site picture awareness, breath control, and trigger squeezing. Each of the four fundamental skills may make a contribution to the level of firing control (e.g., accuracy and precision of a firing event) that the firearm operator attains. When poor firing control is observed, at least one of the four fundamental skills will likely be a source of the undesired firing result. And without mastery of the four fundamental skills, the firearm operator will be hindered from attaining basic marksmanship skills. Therefore, one aim of basic marksmanship training is to identify which firing control actions are contributing to each firing event.

SUMMARY

In particular implementations, systems, devices, and processes for assisting in marksmanship training may include the ability to acquire motion data using a sensor assembly coupled to a firearm during live operation by a firearm operator and detect a firing event based on the acquired motion data. The detection of the firing event may be used to pretrigger recording of the motion data, which may be analyzed to determine firing control operations of a firearm operator, as well as to provide corrective actions for inappropriate firing control actions.

The systems, devices, and processes may provide an affordable and effective marksmanship training aid. For example, they may provide a firearm operator with detailed data regarding the movement of the firearm just before firing. Additionally, they may interpret the results for the operator. Furthermore, they may provide specific actionable feedback for a firearm operator that links barrel movement during a firing event to firing control actions performed by the firearm operator. Thus, a firearm operator may be able to easily grasp, what is occurring and what needs to be remedied.

DESCRIPTION OF THE EMBODIMENT(S)

Figure 1:
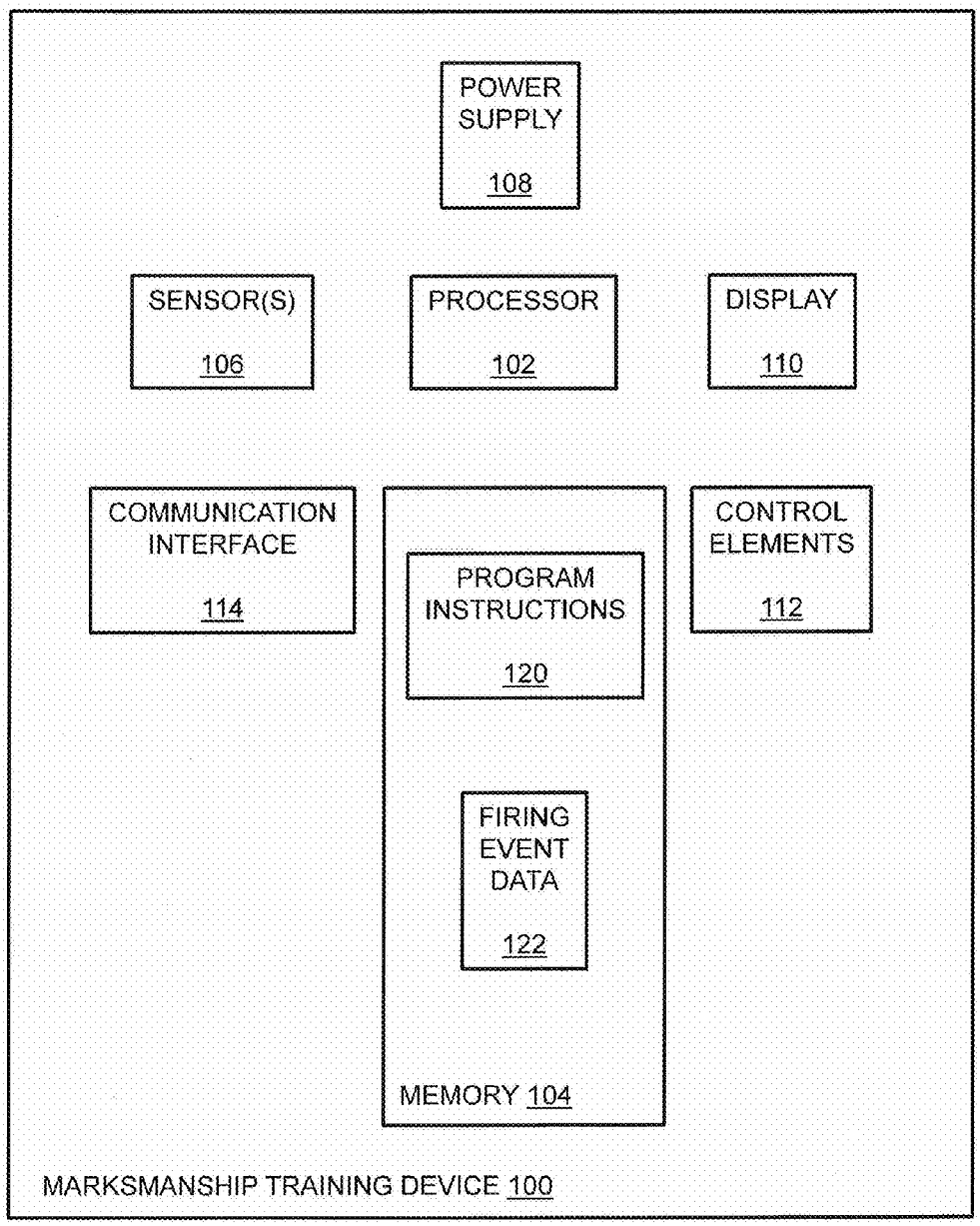
FIG. 1 is a block diagram of selected elements of an example marksmanship training device.

The present disclosure pertains to systems, devices, processes, and techniques for use in marksmanship training As will be described in detail herein, an example marksmanship training device may be incorporated into an actual firearm for use with live ammunition in a real-life firing situation and provide specific actionable feedback to the firearm operator about movement of the weapon during firing. In this manner, the marksmanship training device described herein may represent a relatively simple, cost-effective training aid with widespread applicability and improved marksmanship training value.

In the following description, details are set forth by way of example to facilitate discussion of the disclosed subject matter. It should be apparent to a person of ordinary skill in the field, however, that the disclosed implementations are exemplary and not exhaustive of all possible implementations.

Throughout this disclosure, a hyphenated form of a reference numeral refers to a specific instance of an element and the un-hyphenated form of the reference numeral refers to the element generically or collectively. Thus, for example, widget 12-1 refers to an instance of a widget class, which may be referred to collectively as widgets 12 and any one of which may be referred to generically as a widget 12.

Turning now to the figures, FIG. 1 illustrates selected elements of an example marksmanship training device 100. As shown, marksmanship training device 100 may include various elements and components, of which certain ones are shown in the example implementation for descriptive clarity. It is noted that in various embodiments of marksmanship training device 100, desired elements may be added and/or undesired ones omitted. The description of marksmanship training device 100 in FIG. 1 is intended as a functional representation, and is not intended to restrict any specific physical implementation to a particular form or dimension. For example, different implementations of marksmanship training device 100 may be employed with different types of firearms, as is suitable and/or desired. As will be described in further detail, disclosed embodiments of marksmanship training device 100, which may be a microdevice or a miniaturized device, maybe immovably attached (or affixed) to a firearm to enable detection of movement of the firearm, and more particularly, movement of a firearm shortly before and during a firing event (i.e., discharge of the firearm). It is further noted that marksmanship training device 100 may be used during normal operation of the firearm using live ammunition and without any particular constraints for usage of the firearm by the firearm operator. Accordingly, in particular embodiments, marksmanship training device 100 may be a self-contained, compact device that is readily attached to the firearm and/or include elements that are included in a component attached to the firearm (see also FIG. 2).

As shown in FIG. 1, marksmanship training device 100 includes a processor 102 and memory 104. Processor 102 may, for example, be a microprocessor, a microcontroller, an application specific integrated circuit, or any other device that manipulates data in a logical manner. Processor 102 may represent at least one processing unit and may further include internal memory, such as a cache and/or registers, for storing processor executable instructions. In certain embodiments, processor 102 serves as a main controller for marksmanship training device 100. In various implementations, processor 102 is operable to perform operations associated with marksmanship training systems, as described herein.

Memory 104 is operable to store instructions, data, or both. Memory 104 as shown includes program instructions 120, which may be in the form of sets or sequences of executable instructions, such as applications, routines, or code, for performing marksmanship training (see also FIGS. 6 and 7). Memory 104 is further shown including firing event data 122, representing measured values for the motion (e.g., linear and/or rotational) of the firearm that have been acquired during marksmanship training (see also FIG. 2), for example. In certain implementations, firing event data 122 may further include reference values for motion data and/or other parameters that may be used to analyze data acquired for specific firing events, as will be described in further detail below. It is noted that memory 104 may be available to processor 102 for storing and retrieving other types of information and/or data (not shown in FIG. 1), as desired. Memory 104 may include persistent and volatile media, fixed and removable media, magnetic and semiconductor media, a combination thereof, and/or any other device for storing data.

Also shown included with marksmanship training device 100 in FIG. 1 is one or more sensors 106, which are part of a sensor assembly that includes the mechanisms to attach the sensor(s) to the firearm. Sensor(s) 106 capture motion of the firearm to which marksmanship training device 100 is attached. As will be described in detail with respect to FIG. 2, sensor(s) 106 may be configured to measure motion associated with the firearm along and/or around a number of different dimensions and/or axes. For example, sensor(s) 106 may measure individual orthogonal axes of 3-dimensional linear motion corresponding to a Cartesian coordinate system of X, Y, and Z axes or two rotations and a linear motion for a polar coordinate system. In various embodiments, sensor(s) 106 may also be configured to measure a number of different axes of rotation. The placement (i.e., orientation) of a physical embodiment of sensor(s) 106 relative to the firearm (or a portion of the firearm, such as the firearm barrel) may, for example, determine an orientation of the coordinate system (see also FIG. 2).

Sensor(s) 106 may represent a number of different types of sensors, such as, but not limited to, accelerometers, gyroscopes, Hall-effect sensors, optical sensors, radio-frequency sensors, among others. In certain implementations, sensor(s) 106 include microelectromechanical systems (MEMS) and/or nanoscale components.

Processor 102 may be configured to receive motion data from sensor(s) 106 and store this motion data in memory 104, for example, as firing event data 122. It is noted that, in some embodiments, sensor(s) 106 may include functionality for supplying power, signal conditioning, and/or digitization of motion signals to generate motion data, such as amplifiers and analog-to-digital converters, etc.

Further shown in FIG. 1, communication interface 114 represents a communications transceiver providing an interface for one or more communication links. In certain embodiments, communication interface 114 supports wireless communication links, such as infrared (IR), radio frequency (RF), and audio, among others. Examples of RF wireless links include the IEEE 802.xx family, such as WiFi® (IEEE 802.11) and Bluetooth® (IEEE 802.15.1). In addition to wireless communication links, communication interface 114 may further support mechanically connected communication links, such as galvanically wired connections, sensor interface connections, connections to external antennas, network connections, etc., and may accordingly include a physical adapter or receptacle (not shown in FIG. 1) for receiving such connections. Communication interface 114 may transform an instruction received from processor 102 into a signal sent via a communication medium (not shown in FIG. 1, see FIG. 4), such as a network link. It is noted that communication interface 114 may be a bidirectional interface, such that responses, such as commands, information, or acknowledgements, may be received.

Also depicted in FIG. 1 is a display device represented by display 110. Display 110 may be implemented as a liquid crystal display screen, light emitting diode display screen, a computer monitor, a television, or any other device for visually presenting data. Display 110 may comply with a display standard for the corresponding type of display. Standards for computer monitors include analog standards such as video graphics array (VGA), extended graphics array (XGA), etc., or digital standards such as digital visual interface (DVI), high definition multimedia interface (HDMI), among others. A television display may comply with standards such as National Television System Committee (NTSC), Phase Alternating Line (PAL), or another suitable standard. Display 110 may include additional output devices (not shown in FIG. 1), such as one or more integrated speakers to play audio content, or may include an input device (not shown in FIG. 1), such as a microphone or video camera.

Control elements 112 may be physical or virtual controls, such as buttons, knobs, sliders, etc., that may be operated by the firearm operator. In particular embodiments, control elements 112 may include virtual control elements displayed by display 110 and operable using a touch sensor (not shown in FIG. 1), which may be a touch screen associated with display 110, or other tactile sensor. Accordingly, control elements 112 may represent static as well as dynamic controls that may be reconfigured for various input and output functions, as desired. Control elements 112 may generally be any device by which a user can input data/instructions to device 100.

Also shown included with marksmanship training device 100 in FIG. 1 is power supply 108, which may represent a local power source, such as a battery and/or an interface to an external power supply. Power supply 108 may be configured for DC, AC, or both, and may be configured to convert between various levels of AC and/or DC power. Power supply 108 may be configured to regulate an output voltage or an output current, as desired. Power supply 108 may include a switching system for routing power to desired interfaces, such as to sensor(s) 106, processor 102, display 110, communication interface 114, etc. Accordingly, power supply 108 may be configured to route and switch power connections on command or in a pre-programmed manner, such as under control of processor 102.

In certain modes of operation, after mounting marksmanship training device 100 to the firearm, the firearm operator may be presented with data on display 110 during normal operation of the firearm. Marksmanship training device 100 may be configured to autonomously monitor movement of the firearm and to detect firing events, for example, from a lateral motion parallel to the firearm barrel. Upon detection of a firing event, marksmanship training device 100 may retrieve pretriggered motion data (e.g., horizontal and vertical) of the firearm that were previously collected during monitoring. Marksmanship training device 100 may present motion data (e.g., horizontal and vertical), which describe a short time period prior to the firing event (0.1-3 seconds), on display 110, and may additionally present results of an analysis of the presented data, indicating an evaluation of the firing control actions (good and/or bad) exhibited by the firearm operator during the firing event. In particular implementations, training device 100 may also suggest corrective actions for the firearm operator for inappropriate firing control actions. This procedure may be repeated for each subsequent firing event. In certain implementations, collective analysis results for a number of firing events may be presented. In a further display mode, marksmanship training device 100 may provide the firearm operator with an ability to retrieve and display previous motion data for one or more firing events.

Training device 100 has a variety of features. For example, the firearm operator may receive specific actionable feedback in real-time and during normal (i.e., live fire) operation of the firearm and is assisted in learning how specific firing control actions affect movement of the firearm during a firing event. Such an analysis and immediate feedback of the firearm operator's firing control actions (e.g., without leaving the firing line) provides a significant training aid that may promote efficient and effective mastery of marksmanship skills. Furthermore, this may be done without having an experienced person (e.g., a trainer or a coach) with the operator and may be independent of whether an operator actually hits the target or not. Fundamentally, whether an operator hits the target or not has nothing to do with their mastery of marksmanship and can often work against that mastery (e.g., the person who is consistently hitting the target while not operating the firearm properly). Training device 100 may also be used in field situations (e.g., when not on a practice range or using reliably verifiable targets) to assist an operator with determining whether he is operating the firearm appropriately.

Figure 2:
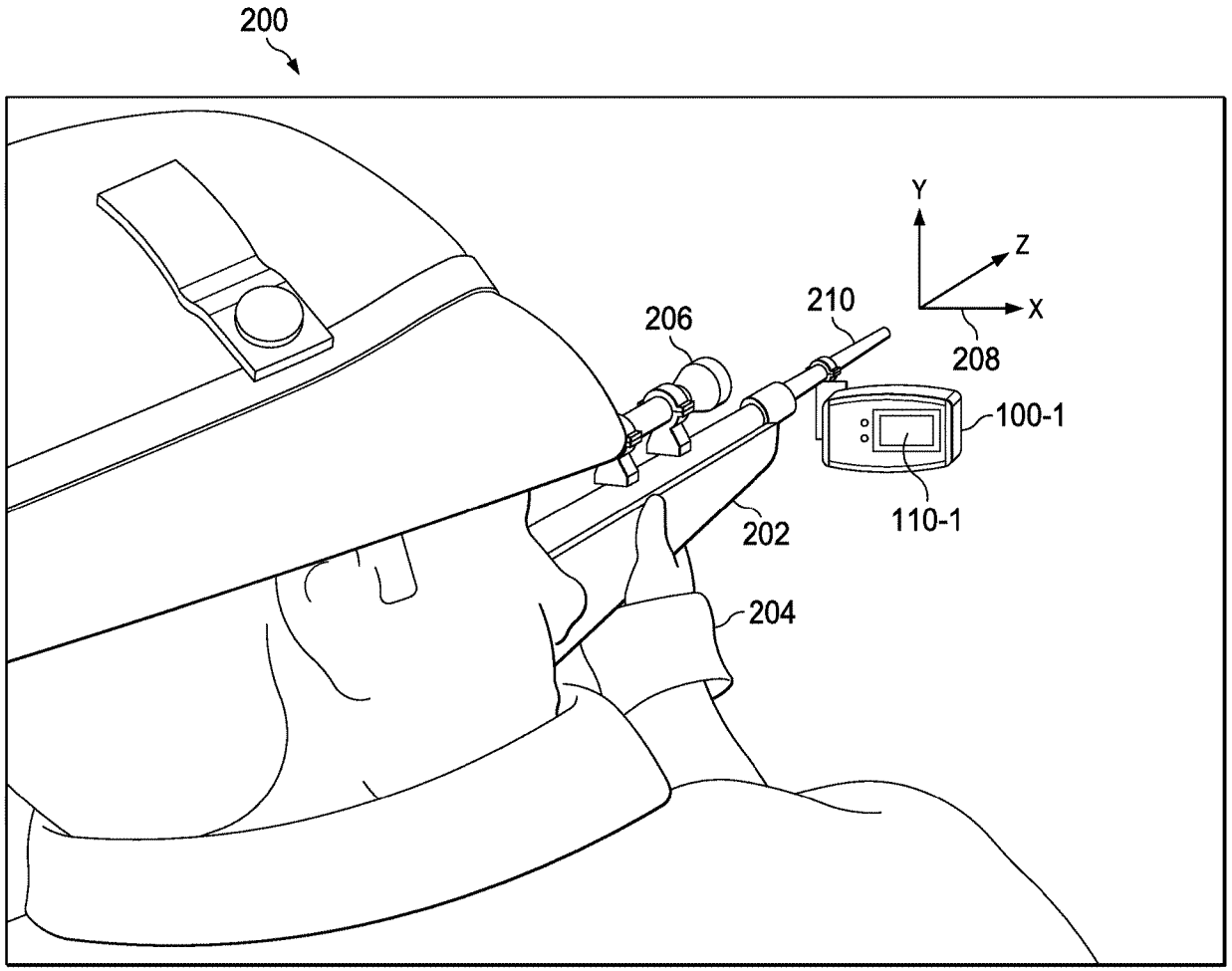
FIG. 2 is a drawing illustrating an example marksmanship training device in use.

Turning now to FIG. 2, an application of marksmanship training device 100 is shown. It is noted that like numbered elements in FIG. 2 correspond to the same elements in FIG. 1, such as marksmanship training device 100 and display 110. In FIG. 2, firearm operator 204 is shown operating firearm 202, which has been equipped with marksmanship training device 100-1 mounted directly to firearm barrel 210. Marksmanship training device 100-1 is shown with display 110-1 arranged in direct sight of firearm operator 204. It is noted that in other implementations, marksmanship training device 100 may be configured in various physical forms and mounting variations. In one embodiment, for example, marksmanship training device 100 may be included in ocular scope 206 mounted to firearm barrel 210, such that results displayed by marksmanship training device 100 are visible in the same field of view as the target. In various embodiments, marksmanship training device 100 may be incorporated into other ocular instruments (not shown in FIG. 2) mounted on firearm 202.

In FIG. 2, coordinate system 208 defines a 3-dimensional Cartesian space, with a lateral Z-axis parallel to firearm barrel 210, along with a horizontal X-axis and a vertical Y-axis that are respectively perpendicular to firearm barrel 210. Coordinate system 208 may be used by marksmanship training device 100 to generate motion data for each individual axis, as described previously.

Figure 3A:
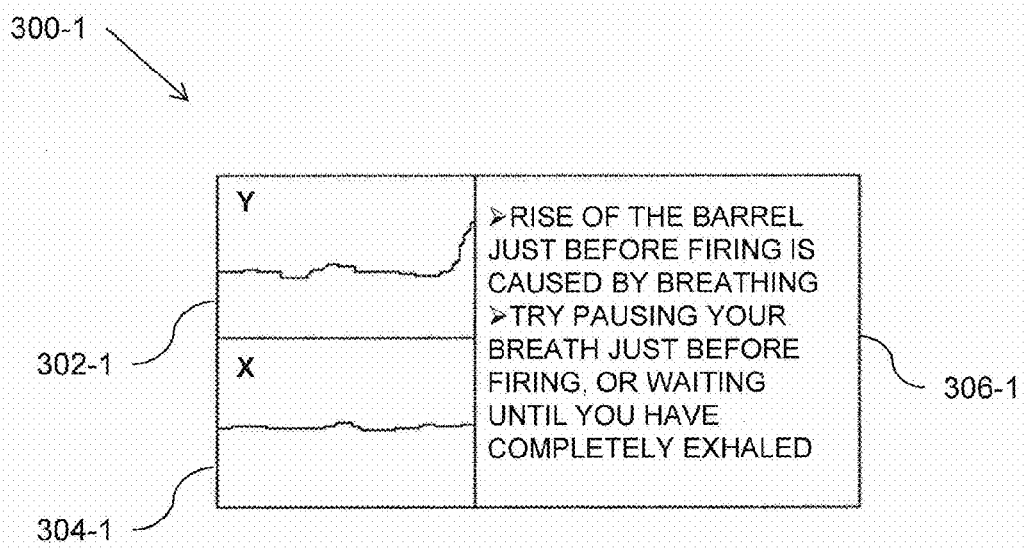
FIGS. 3A and 3B are example user interfaces generated by an example marksmanship training device.
Figure 3B:
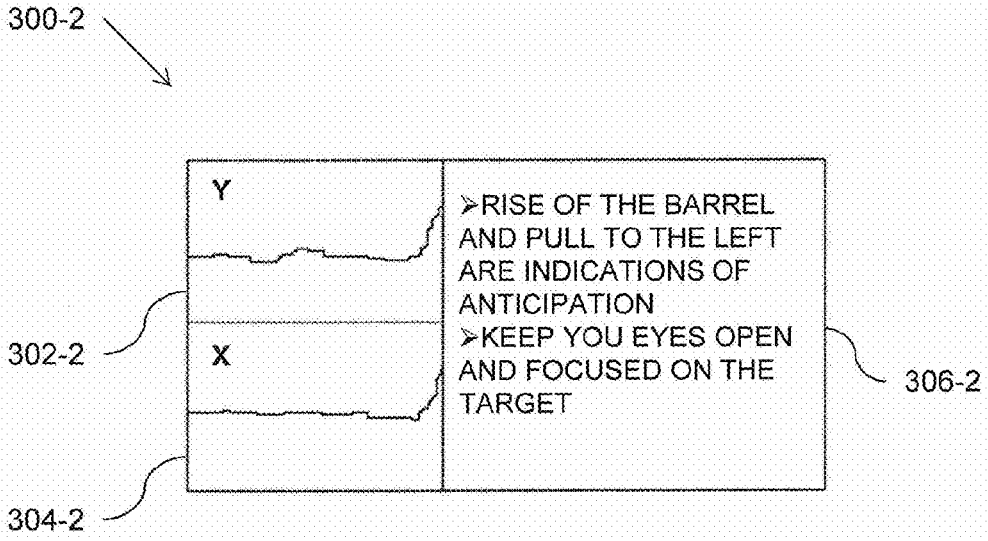

FIGS. 3A-3B illustrate example user interfaces 300 generated by a marksmanship training device 100. The user interfaces may be presented on display 110.

User interface 300-1 shows one example of an output that device 100 may generate after detecting and analyzing a firing event, as described herein. The elements shown in FIG. 3A may represent motion data captured prior to the firing event and analysis results for marksmanship training Specifically, vertical Y-axis data 302-1 represents a motion, either absolute or relative, along Y-axis of coordinate system 208 (see FIG. 2) that the firearm was subjected to over a time period prior to the firing event. The time period may be fixed or may be subject to modification by the firearm operator, for example, using control elements 112 (see FIG. 1). In particular implementations, the baseline position is determined by averaging the position over a short time before firing (e.g., 0.5-1.0 seconds), and the displayed results are over the last few milliseconds before firing. Horizontal X-axis data 304-1 represents a motion, either absolute or relative, along X-axis of coordinate system 208 over a similar time period prior to the firing event. Training aid 306-1 provides analysis results for aiding the firearm operator in understanding which actual firing control actions were observed during the previous firing event, along with suggestions for improving firing control actions—proper breathing techniques, in this example.

User interface 300-2 depicts another example of an output that device 100 may generate after a firing event, with vertical Y-axis data 302-2 and horizontal X-axis data 304-2 again showing movement of the firearm. Additionally, training aid 306-2 provides analysis results regarding firing control actions and actionable feedback to the firearm operation.

Other types of analysis results and feedback are also possible. For example, if the firearm moves to the left without any rise in the barrel during firing, this may indicate that the operator's front hand is tensing. The operator may thus be told to relax his front hand. As another example, if the firearm moves to the right without any rise in the firearm during firing, this may indicate that the operator is not pulling straight back on the trigger. The human hand has a tendency to curl as it contracts the index finger. Thus, the operator may be instructed to pull the trigger straight back. As a further example, a movement of the firearm to the right along with a clockwise rotation of the firearm may indicate that the operator is not swinging the firearm properly. The operator may thus be informed to traverse the firearm cleanly. As an additional example, problems with site picture may be identified. Although site picture is not directly quantifiable by the device, it may be indirectly determined through eliminating measurable data errors. For example, if no unacceptable motion is measured by the training aid and there is a miss, the elimination of trigger and breathing error implies poor site picture (e.g., the operator is not properly lining up the weapon siting mechanisms with the target). Feedback may also be provided for firing control actions that are being executed appropriately (e.g., breathing appears good, trigger pull is good, etc.).

Furthermore, although immediate feedback may be concise and direct, additional feedback may be available and may take the form of video and/or audio explanations stored and/or streamed to the user interface portion of the marksmanship training system. For example, if the user interface portion is a web-enabled, feedback for an error (e.g., trigger squeeze) may include a link to a video (e.g., on YouTube) where a professional marksman explains trigger squeeze, how it affects firing, and how to improve.

Additionally, analysis and feedback may be based on the results of shots and/or a series of firings. For example, whether a shot hit or missed and/or which shot(s) missed in a series of firings may be analyzed to identify operator errors. For instance, when zeroing a rifle, three consecutive shots are typically fired at a range of 25 meters, attempting to group all three shots within an area the size of a quarter. Often, two shots will fall within the target area while the third falls significantly outside. By analyzing which shot missed, operator error may be indicated. For instance, two accurate shots followed by improper trigger squeeze, resulting in a shot to the right, on the third round often indicates impatience and loss of focus. As another example, a shot left and high on the first round while the other shots are good may indicate initial anticipation of recoil, which decreases after the first round does not deliver on the initial anticipated violence. Thus, analyzing the results of shots and/or a series of firings may provide further feedback to a firearm operator that they can use when the next try zero the firearm (e.g., fire two rounds as previously and focus on making adjustments on the misfired round).

Figure 4:
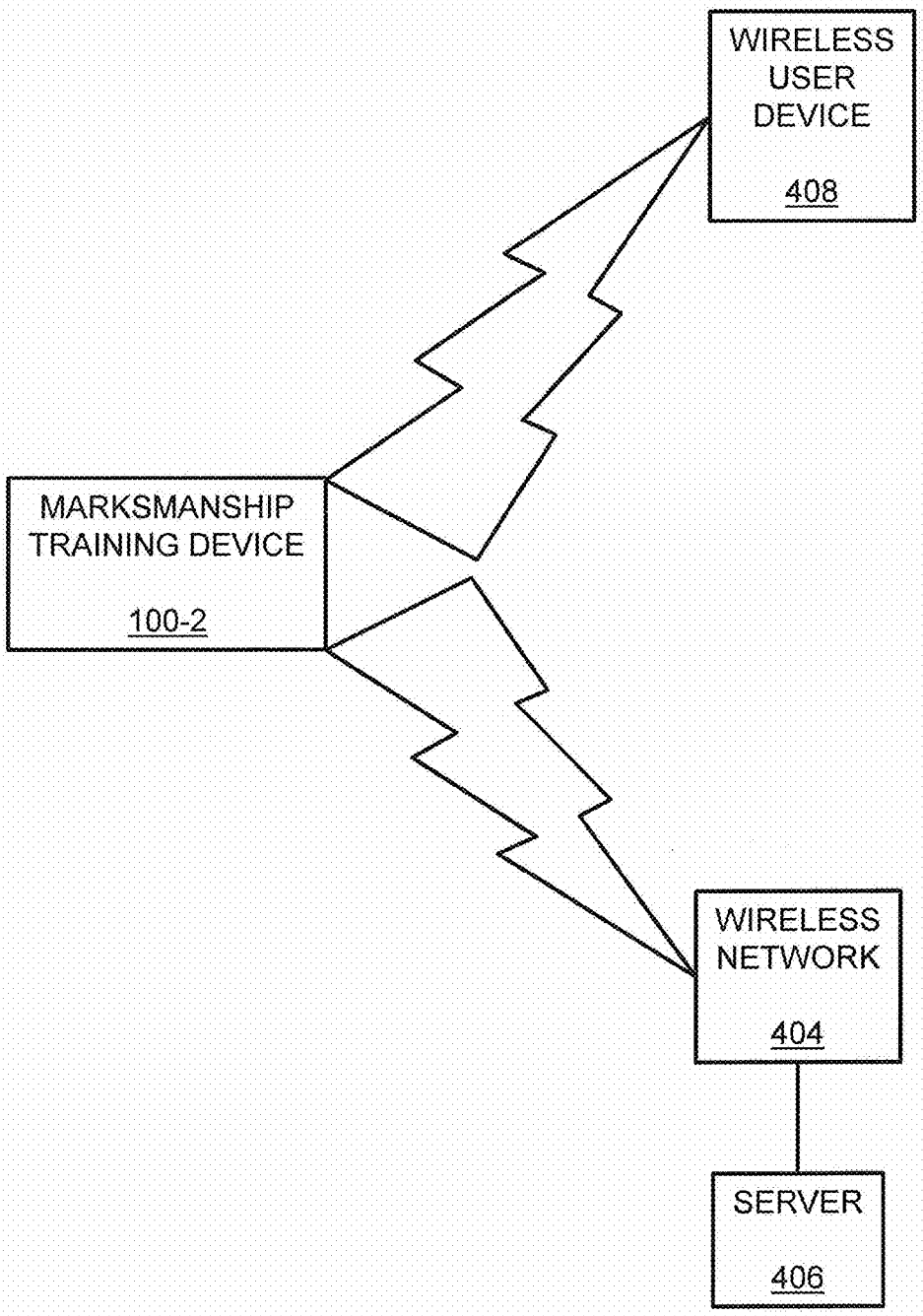
FIG. 4 is a block diagram of selected elements of an example marksmanship training system.

FIG. 4 illustrates selected elements of an example marksmanship training system 400. In marksmanship training system 400, marksmanship training device 100-2 may represent various embodiments, as described herein, and is shown without internal details for descriptive clarity. In FIG. 4, marksmanship training system 400 has communication links 402-1 and 402-2 between marksmanship training device 100-2 and external entities, which are shown as exemplary embodiments. For example, marksmanship training device 100-2 may communicate via communication link 402-1 with wireless user device 408, which may represent a smart phone, a tablet, a personal digital assistant, a laptop, or other mobile communication device with application processing capacity. Wireless user device 408 may be in possession of the firearm operator or other persons associated with marksmanship training system 400, such as a trainer, coach, etc. It is noted that an application executing on wireless user device 408 may specifically be configured to operate with one or more instances of marksmanship training device 100. In one implementation, a message may be sent to wireless user device 408 via wireless communication link 402-1 and an acknowledgement of the message may be received from wireless user device 408 via wireless communication link 402-1, such that the message is sent and the acknowledgment is received via communication interface 114 (see FIG. 1). The message may include firing event data 122 for display and/or processing by wireless user device 408.

In certain implementations, wireless user device 408 may receive firing event data/analysis from a number of marksmanship training devices 100. Thus, a coach may monitor several trainees at once and be able to identify any who need special assistance. In some implementations, wireless user device 408 may receive the firing event data and perform the analysis to determine what firing control actions occurred and if any were improper and/or proper.

Similarly, marksmanship training device 100-2 may communicate via communication link 402-2 with wireless network 404, which may be linked to a server 406. Server 406 may include one or more processors, short term memory (e.g., random access memory (RAM)), and long-term memory (e.g., ROM and disk memory), and in particular implementations may be an applicator server. Wireless network 404 may be a wide-area wireless network, such as a cellular telephony network or a satellite network, for example. Wireless network 404 may enable marksmanship training device 100-2 to communicate with server 406 to exchange application data, commands, measurement data, and firing event data, as desired. In certain embodiments, server 406 includes, and/or is coupled to, a database system (not shown in FIG. 4) that may serve as a repository for firing event data for different firearms, firearm operators, and marksmanship training devices 100, and that is configured to provide marksmanship training services to a number of different users for various purposes, such as training, skills improvement, evaluation, monitoring, analysis, trending, testing, certification to a desired standard, standards development, among others.

Example reports include after action review reports. For example, trend reports for an individual operator or group of operators may indicate the times of greatest increase or decrease in error. If a general increase in error occurs after the fourth hour of training, that may indicate fatigue and measures may be taken during the next training period to minimize the effect. As another example, alerts may be generated for a coach or a commander when there is an increase in firing error over time for a specific operator indicating a poor grasp of the fundamentals of marksmanship and the need for further basic marksmanship training outside of a live-fire environment.

Figure 5:
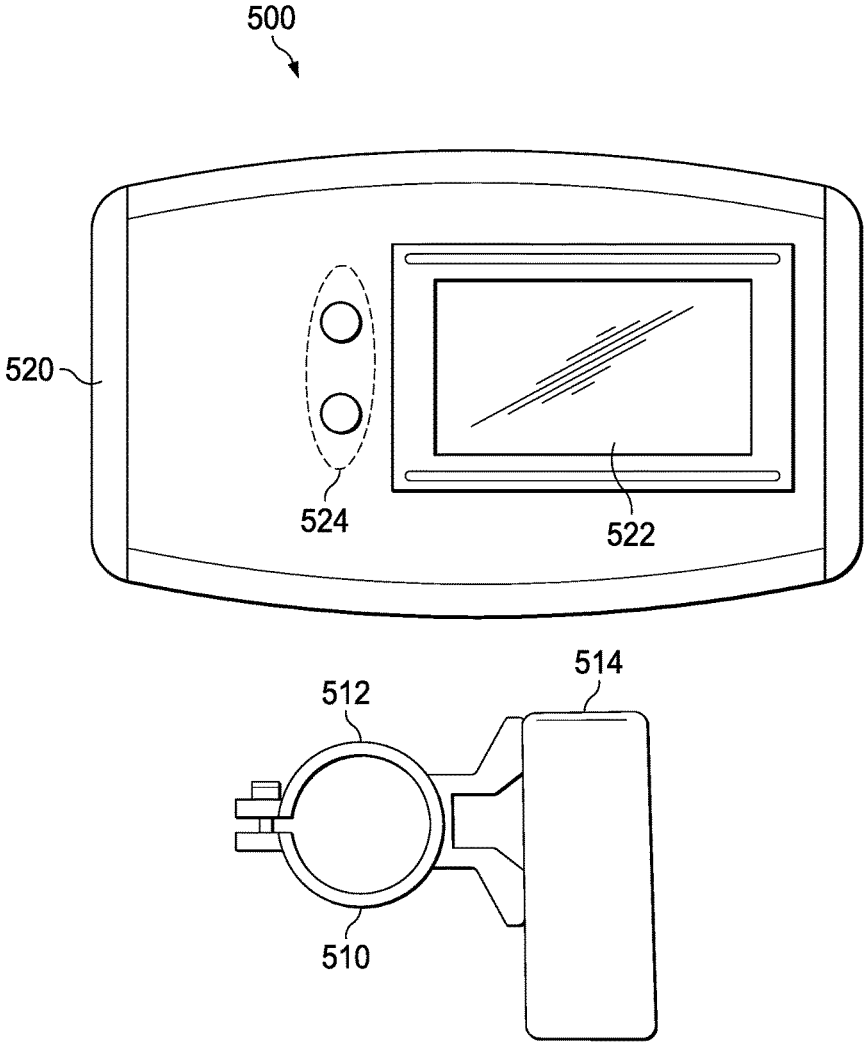
FIG. 5 is a line drawing illustrating selected elements of another example marksmanship training system.

FIG. 5 illustrates another example marksmanship training system 500. System 500 includes a firearm portion 510 and a local display device 520.

Firearm portion 510 includes a mounting assembly 512 and an electronics housing 514. As illustrated, mounting assembly 512 may couple firearm portion 510 directly to the barrel of a firearm. Electronics housing 514 houses the electronics for firearm portion 510. For example, electronics housing 510 may, among other things, house a power supply (e.g., a battery), one or more sensors (e.g., accelerometers), a processor, a communication interface (e.g., an RF interface), and memory (e.g., RAM), which may store instructions and data (e.g., firing event data). Firearm portion 510 may be made of aluminum, polymer (e.g., a high temperature polymer such as acetal copolymer), or any other appropriate material.

Local display device 520 is adapted to process measurement data and visually present it to a user. As illustrated, local display device 520 includes a display 522 and control elements 524. Inside, local display device 520 may include, among other things, include a power supply (e.g., a battery), a processor, a communication interface (e.g., an RF interface), and memory (e.g., RAM), which may store instructions and data (e.g., firing event data).

To set system 500 up for operation, firearm portion 510 maybe mounted to a firearm by manipulating mounting assembly 512. Additionally local display 520 may be turned on and the appropriate function selected using control elements 524. Local display device 520 may establish a wireless link between firearm portion 510 and local display device 520.

As an operator uses the firearm to which firearm portion 510 is attached, the processor for local firearm portion 510 may accumulate motion data and send it to local display device 520 using the communication interface. The processor of local display device 520 may then analyze the data to determine if a firing event has occurred and pretrigger the storage of data for a short time before the firing event. Local display device 520 may then generate a user interface to present the pretriggered data to the operator and also analyze the pretriggered data to determine whether inappropriate firing actions occurred (e.g., closing of eyes, incorrect trigger pull, etc.). If an inappropriate firing action occurred, local display 520 may generate a user interface that presents the results of the analysis and possibly feedback regarding corrections to the inappropriate firing actions. Local display device 520 may also present analysis results regarding appropriate firing control actions, as well as training audios and/or videos that correspond to detected errors (e.g., breathing, trigger pull, etc.) may be provided to an operator.

System 500 has a variety of features. For example, by separating the motion detection functions from the analysis and display functions, the weight and size of the firearm-mounted portion may be reduced (e.g., to a few ounces). A reduction in the weight for the firearm portion may produce a more realistic shooting experience for the operator and reduce aiming errors due to having an additional component mounted to the firearm. Reducing the size of the firearm-mounted portion may also provide less distraction and psychological anxiety for the operator.

Additionally, having display device 520 separate may allow the display unit to receive firing event data from multiple firearms. This may, for example, be useful in a military training context when there is approximately one coach per eight trainees. If the firearm portions for several firearms are downloading to a central unit, the coach may be able to identify which trainees require assistance. (The firearm portion could also be downloading to a central computer that is collecting data for every firearm on the range.)

Figure 6:
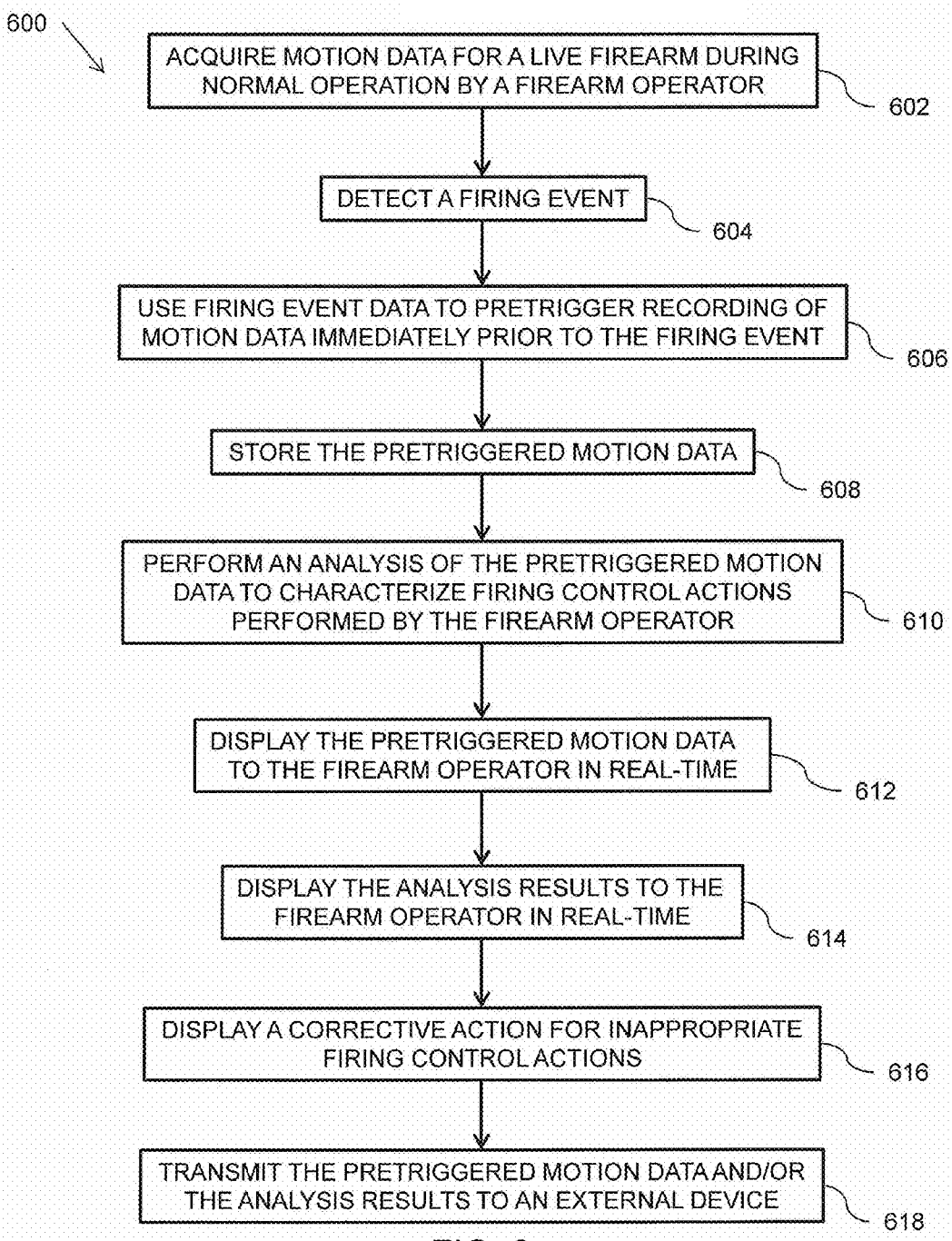
FIG. 6 is a flowchart illustrating an example process for performing marksmanship training

FIG. 6 illustrates an example process 600 for performing marksmanship training using a marksmanship training system, as described herein. In certain implementations, process 600 is performed by a processor executing program instructions such as program instructions 120 (see FIG. 1). It is noted that certain operations described in process 600 may be optional or may be rearranged in different embodiments. It is also noted that process 600 may be performed repeatedly for a number of different firing events.

Process 600 calls for acquiring (operation 602) motion data for a live firearm during normal operation (e.g., on a firing range or in the field) by a firearm operator. The data may, for example, be X-, Y-, Z-axis translation data and/or rotational data. Process 600 also calls for detecting a firing event (operation 604). A firing event may, for example, be detected by a sudden motion along the longitudinal axis indicative of a firing of the firearm. The firing event may be used (operation 606) to pretrigger recording of motion data immediately prior to the firing event. The motion data may, for example, be along a lateral axis. The pretriggered recording may involve continuous buffering of motion data and readout of a given time period of motion data prior to the firing event (e.g., 0.1-3 seconds). The pretriggered motion data may be stored (operation 608). The motion data may be stored on the marksmanship training device mounted to the firearm and/or may be transmitted to an external device/system for storage.

Process 600 also calls for analyzing the pretriggered motion data (operation 610) to characterize firing control actions performed by the firearm operator. The pretriggered motion data may be displayed (operation 612) to the firearm operator in real-time. As used herein, "real-time" shall refer to operations that occur substantially simultaneously or instantaneously with minimal delay. For example, a real-time display of analysis results of a firing event shall refer to a display shortly following the firing event. Displaying data may include generating (e.g., selecting and/or forming) user interface by a processor and presenting the user interface on a display.

Process 600 also calls for displaying the analysis results to the firearm operator in real time (operation 614). The results may be displayed with or separate from the motion data. Process 600 further calls for displaying a corrective action for inappropriate firing control actions (operation 616). The corrective action(s) may be displayed with the analysis results. The analysis results and/or the pretriggered motion data may then be transmitted (operation 618) to an external device (e.g., a server). The external device may, for example, store a series of results for further analysis.

Although FIG. 6 illustrates an example process for marksmanship training, other processes for marksmanship training may include fewer, additional, and/or a different arrangement of operations. For example, the motion data may be transmitted to a local display device, such as local display 520, for analysis and providing the results, along with any corrective actions. As another example, the results and/or the motion data may not be transmitted to an external device. As another example, the results and/or the motion data may be transmitted before or during analysis of the motion data. As a further example, a process may begin by detecting a ready command (e.g., from a user or a device). As an additional example, data from various firing events may be analyzed to establish patterns and/or trends (e.g., consistent actions for certain types of shots, improvement of certain skills, worsening of certain skills, etc.). As another example, corrective action(s) may not be displayed. As another example, information regarding appropriate firing control actions may be displayed (e.g., good, satisfactory, etc.). As a further example, training audios and/or videos that correspond to detected errors (e.g., breathing, trigger pull, etc.) may be provided to an operator.

Figure 7:
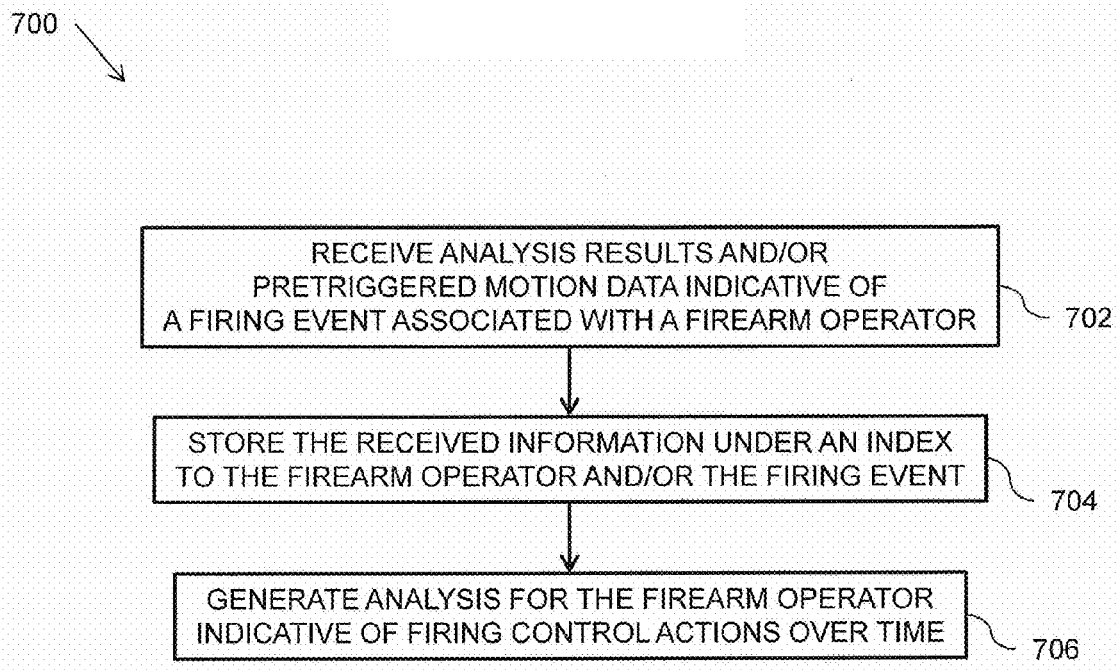
FIG. 7 is a flowchart illustrating another example process for performing marksmanship training

Turning now to FIG. 7, another example process 700 for marksmanship training is illustrated in flowchart form. In some implementations, process 700 is performed by a processor executing program instructions 120 (see FIG. 1). In other implementations, an application may be configured to perform process 700 by execution on wireless user device 408 and/or application server 406, in conjunction with wireless network 404, for example, by transmitting firing event data 122 to application server 406 (see FIGS. 1 and 4). It is noted that certain operations described in process 700 may be optional or may be rearranged in different embodiments. Process 700 may be performed using any combination of marksmanship training devices 100, 200, 300 and/or marksmanship training system 400. It is noted that process 700 may be performed repeatedly for a number of different firing events.

Process 700 calls for receiving analysis results and/or pretriggered motion data that are indicative of a firing event associated with a firearm operator (operation 702). The received information is stored under an index to the firearm operator and/or the firing event (operation 704). Process 700 further calls for generating an analysis (e.g., a trend report) for the firearm operator indicative of firing control actions over time (operation 706). Other types of reports for a given firearm operator, a given firearm, or according to other parameters, may be generated in various implementations.

While the subject of this specification has been described in connection with one or more exemplary embodiments, and/or implementations, it is not intended to limit the claims to the particular forms set forth. Additionally, those skilled in the art will readily recognize that various additions, deletions, substitutions, and modifications may be made to the various implementations while still achieving marksmanship training Thus, the scope of protection should be based on the following claims, which may encompass one or more features of one or more implementations.

What is claimed is:

1. A marksmanship training system, the system comprising:

a sensor assembly adapted to be coupled to a firearm and to acquire motion data during live operation by a firearm operator;

memory operable to store data from the sensor and instructions;

a processor, according to the instructions, adapted to:

detect a firearm firing event based on output provided by the sensor assembly;

use the firing event to pretrigger recording of output provided by the sensor assembly before the firing event analyze the pretriggered motion data to determine firing control actions performed by a firearm operator;

generate, shortly after the firing event, a user interface comprising information describing the firing control actions; and generate a user interface that provides corrective action after the firing event for inappropriate firing control actions.

2. The system of claim 1, further comprising a display to present results of a firearm firing event to a firearm operator.

3. The system of claim 2, wherein the display is integrated with the motion sensor to present the data on the firearm.

4. The system of claim 3, wherein the integrated display is included in an ocular instrument adapted for attachment to a firearm.

5. The system of claim 1, wherein the processor is further adapted to generate, in real-time, a user interface that presents an indication of the pretriggered motion data.

6. The system of claim 1, wherein the sensor assembly is adapted to sense horizontal motion and vertical motion.

7. The system of claim 1, comprising a communication interface for communicating with external devices.

8. The system of claim 7, wherein the communication interface includes a wireless interface.

9. The system of claim 7, further comprising a remote computer system adapted to generate, in real-time, a user interface that presents the pretriggered motion data.

10. The system of claim 7, wherein the remote computer system is further adapted to:

analyze the pretriggered motion data to determine the firing control actions performed by the firearm operator; and generate, in real-time, information describing the firing control actions.

11. The system of claim 7, further comprising a remote computer system adapted to store the firing event data for a firearm operator for a number of firing events.

12. The system of claim 11, wherein the remote computer system is further adapted to analyze the firing event data for a firearm operator over a number of firing events.

13. The system of claim 1, wherein the processor is configured to provide body control feedback to the user that is unrelated to active arm muscle control.

14. The system of claim 1, wherein the sensors comprise multiple accelerometers, each accelerometer acquiring a different movement degree of freedom of the firearm, the processor configured to analyze data from the accelerometers to determine firing control actions performed by a firearm operator, generate a user interface comprising information describing the firing control actions, and generate a user interface providing corrective action for inappropriate firing control actions.

15. The system of claim 1, wherein the firing control actions are described graphically and the corrective action is described textually.

16. A method for marksmanship training, comprising:

acquiring motion data using a sensor assembly coupled to a firearm during live operation by a firearm operator;

detecting a firing event based on the acquired motion data;

using the firing event to pretrigger recording of the motion data before the firing event;

analyzing the recorded motion data to determine firing control actions performed by a firearm operator;

displaying, shortly after the firing event, information describing the firing control actions;

and displaying corrective action after the firing event for inappropriate firing control actions.

17. The method of claim 16, further comprising displaying, in real-time, an indication of the motion data recorded prior to the firing event.

18. The method of claim 17, wherein displaying the indication is performed for viewing by the firearm operator during live operation of the firearm.

19. The method of claim 16, further comprising communicating the firing event data to external devices.

20. The method of claim 19, further comprising storing firing event data for a firearm operator for a number of firing events at a remote computer system.

21. The method of claim 20, further comprising analyzing the firing event data for a firearm operator at the remote computer system over a number of firing events.

22. A marksmanship training system, the system comprising:

memory operable to store data from a sensor assembly adapted to be mounted to a firearm and to acquire motion data during live operation by a firearm operator; and a processor adapted to:

detect a firearm firing event based on the motion data;

use the firing event to pretrigger recording of motion data before the firing event:, analyze the recorded motion data to determine firing control actions performed by a firearm operator;

generate, shortly after the firing event, a user interface describing the firing control actions; and generate a user interface that provides corrective action for inappropriate firing control actions.

23. The system of claim 22, wherein the processor is further adapted to generate a user interface that presents the recorded motion data.

24. The system of claim 22, further comprising a computer system remote from the first processor, the computer system adapted to:

receiving motion data from the processor;

analyze the pretrigger motion data to determine firing control actions performed by a firearm operator; and generate, in real-time, a user interface comprising information describing the firing control actions.

25. The system of claim 24, wherein the computer system is further adapted to generate a user interface that provides corrective action for inappropriate firing control actions.

* * * * *